US009580935B2

(12) United States Patent
Singh

(10) Patent No.: US 9,580,935 B2
(45) Date of Patent: Feb. 28, 2017

(54) ELECTRIC STRIKE ASSEMBLY

(71) Applicant: Rutherford Controls International Corp., Cambridge (CA)

(72) Inventor: Mandeep Singh, Kitchener (CA)

(73) Assignee: RUTHERFORD CONTROLS INT'L INC., Cambridge, Ontario (CA)

( * ) Notice: Subject to any disclaimer, the term of this patent is extended or adjusted under 35 U.S.C. 154(b) by 299 days.

(21) Appl. No.: 13/647,854

(22) Filed: Oct. 9, 2012

(65) Prior Publication Data

US 2013/0088023 A1 Apr. 11, 2013

Related U.S. Application Data

(60) Provisional application No. 61/545,384, filed on Oct. 10, 2011.

(51) Int. Cl.
*E05B 15/02* (2006.01)
*E05B 63/00* (2006.01)
(Continued)

(52) U.S. Cl.
CPC ..... *E05B 63/0056* (2013.01); *E05B 15/024* (2013.01); *E05B 15/0245* (2013.01);
(Continued)

(58) Field of Classification Search
CPC ..... E05B 15/0245; E05B 47/0047; E05B 63/0056; E05B 17/20; E05B 2015/021;
(Continued)

(56) References Cited

U.S. PATENT DOCUMENTS 4,867,496 A * 9/1989 Thomas ..... 292/341.16
5,118,151 A * 6/1992 Nicholas et al. ..... 292/341.19
(Continued)

FOREIGN PATENT DOCUMENTS

CA 2124125 A1 * 11/1994 ..... E05F 1/00

OTHER PUBLICATIONS

International PCT Search Report and the Written Opinion issued for PCT/CA2012/050710.
(Continued)

*Primary Examiner* — Kristina Fulton
*Assistant Examiner* — Christine M Mills
(74) *Attorney, Agent, or Firm* — Baker & Hostetler LLP

(57) ABSTRACT

An electric strike assembly includes a housing including a mounting device and defining an internal longitudinal cavity, a keeper pivotally arranged in the housing, and a selectively locatable component including a locking device to cooperate with the mounting device to secure the component at a predetermined incremental position along the length of the removable cavity. In accordance with other aspects of the present invention, an electric strike assembly includes a housing defining an internal longitudinal cavity, a keeper pivotally arranged in the housing, and a keeper shim assembly, including a shim, slidably engaged with the keeper to position the shim at a predetermined position along a length of the cavity. A method of securely capturing a latch bolt mounted in a door includes mounting an electric strike assembly in an associated door jamb and positioning a shim at a predetermined position in the cavity.

21 Claims, 19 Drawing Sheets

(51) Int. Cl.
*E05B 47/00* (2006.01)
*F28D 7/16* (2006.01)
*E05B 17/20* (2006.01)

(52) U.S. Cl.
CPC ..... *E05B 47/0047* (2013.01); *F28D 7/1676* (2013.01); *E05B 15/021* (2013.01); *E05B 17/20* (2013.01); *E05B 2047/0069* (2013.01); *E05B 2047/0073* (2013.01); *E05B 2047/0076* (2013.01); *Y10T 292/699* (2015.04); *Y10T 292/705* (2015.04)

(58) Field of Classification Search
CPC ..... E05B 2015/024; E05B 2047/0073; E05B 2047/0076; E05B 2047/0069; E05B 15/024; E05B 15/021; Y10T 292/699; Y10T 292/705
USPC ..... 292/340, 341, 341.12, 341.14, 341.15, 292/341.17, 341.18, 341.16, 244; 49/280
See application file for complete search history.

(56) References Cited

U.S. PATENT DOCUMENTS 5,511,839 A * 4/1996 Fuss et al. ..... 292/341.18
5,757,269 A * 5/1998 Roth ..... E05B 45/083 200/61.68
5,850,753 A * 12/1998 Varma ..... 70/278.7
6,299,225 B1 * 10/2001 Chang ..... E05B 47/0047 292/341.16
6,581,991 B2 * 6/2003 Galindo ..... E05B 47/0046 292/144
7,144,053 B2 * 12/2006 Bashford ..... 292/341.16
7,503,599 B2 3/2009 Ward
7,540,542 B2 * 6/2009 Geringer ..... E05B 47/0047 292/341.16
7,669,902 B2 3/2010 Orbeta
8,096,594 B2 1/2012 Uyeda
8,146,966 B1 4/2012 Webb et al.
8,366,160 B2 * 2/2013 Orbeta ..... E05B 15/0093 292/341.16
8,783,744 B2 * 7/2014 Scheffler et al. ..... 292/341.18
2006/0175841 A1 * 8/2006 Toma ..... E05B 47/0047 292/240
2008/0006069 A1 * 1/2008 Liao ..... E05B 47/0047 70/413
2010/0116006 A1 * 5/2010 Huang ..... E05B 47/0047 70/91
2010/0127518 A1 * 5/2010 Huang ..... E05B 47/0047 292/341.16
2011/0031768 A1 † 2/2011 Scheffler
2011/0181060 A1 * 7/2011 Geringer ..... E05B 47/0047 292/341.16
2013/0328332 A1 * 12/2013 Scheffler ..... E05B 47/0047 292/341.16

OTHER PUBLICATIONS

Canadian Office Action dated Aug. 12, 2016, in Canadian Patent Application No. 2,850,072.
Hanchett Entry Systems, Inc., 2009 Catalog, 10 pages (2009).†
Yale Security Inc., Electrified Products, 5 pages (2004).†
Hanchett Entry Systems, Inc., 1003/1004 Series Electric Strikes, 2 pages (2001).†
Hanchett Entry Systems, Inc., Catalog Nos. J-9211, K-9211, N-9211, A-9211, T-9211, H-9211, R-9211, E-9211, -2-9211, 9 pages (1992).†

* cited by examiner
† cited by third party

ELECTRIC STRIKE ASSEMBLY

CROSS-REFERENCE TO RELATED APPLICATION

This application claims priority to U.S. provisional patent application Ser. No. 61/545,384, filed on Oct. 10, 2011, the disclosure of which is incorporated herein by reference in its entirety.

FIELD OF THE INVENTION

The present invention relates to door locking mechanisms, more particularly to electric door locking mechanisms known as electric strikes.

BACKGROUND OF THE INVENTION

Electric strikes, also known as electric door openers, electric releases and electric release strikes, are part of a locking mechanism conventionally used to control access to buildings or areas, for example. An electric strike assembly is typically mounted into a door jamb and receives a locking feature, such as a latch bolt and/or a dead bolt, which is part of a locking mechanism typically mounted in a door. An actuation means (e.g., an electrically driven motor or solenoid) is used to either block or release a rotatable keeper to either prevent or allow release of a door's latch bolt, to lock the door or allow it to be opened.

There is a wide variety of lock sets available in the market, with different lock sets often having locking features that engage the strike assembly at different positions with respect to a strike center. Conventional strike assemblies thus include faceplates having a hole(s) provided at a set position for receiving the locking feature(s). As such, when a different lock set is desired and/or exchanged for a replacement lock set, often the faceplate and/or the entire strike assembly must be simultaneously replaced to accommodate the dimensions of the new lock set. Due to this lack of interchangeability, conventional lock sets and strikes are often sold together as a packaged set even if only one component may be desired. The result is an increase in the cost of the product to the consumer as well as an increased cost for the associated installation of the packaged set. There is a need and desire for an electric strike assembly that is adjustable to accommodate dimensional differences in the locking features of corresponding lock sets.

Furthermore, for conventional electric strike assemblies to include certain optional devices, such as a latch monitor module, for example, the optional device must be built into the strike assembly. As such, a consumer must decide up front whether to include or exclude the optional feature or face the prospect of having to entirely replace the strike assembly and/or lock set if the optional feature later becomes desirable or, conversely, is no longer required. Accordingly, there is a need and desire to improve the form, fit and function of electric strike assemblies by providing an electric strike assembly having interchangeable and adjustable optional components that may be easily and efficiently installed or removed.

SUMMARY OF THE INVENTION

Embodiments of the present invention advantageously provide an electric strike assembly and methods of use thereof. A preferred embodiment of an electric strike assembly includes a housing having a positioning member and an internal longitudinal cavity, a keeper pivotally arranged in the housing, and a selectively locatable component having an engagement member to cooperate with the positioning member to secure the component at a predetermined incremental position along a length of the cavity.

In accordance with other aspects of the present invention, an electric strike assembly includes a housing including an internal longitudinal cavity, a keeper pivotally arranged in the housing, and a keeper shim assembly, including a shim, slidably engaged with the keeper to position the shim at a predetermined position along a length of the cavity.

In accordance with yet other aspects of the present invention, a method of securely capturing a latch bolt mounted in a door includes mounting an electric strike assembly in an associated door jamb, the electric strike assembly having a housing including an internal longitudinal cavity, a keeper pivotally arranged in the housing, and a keeper shim assembly, including a shim, slidably engaged with the keeper to position the shim at a predetermined position along a length of the cavity, and positioning the shim at the predetermined position in the cavity to be in substantial alignment with a position of the latch bolt mounted in the door.

There has thus been outlined, rather broadly, certain embodiments of the invention in order that the detailed description thereof may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and constitute a part of this specification, illustrate various embodiments consistent with the invention, and, together with the description, serve to explain the principles of the invention.

DETAILED DESCRIPTION

Figure 1:
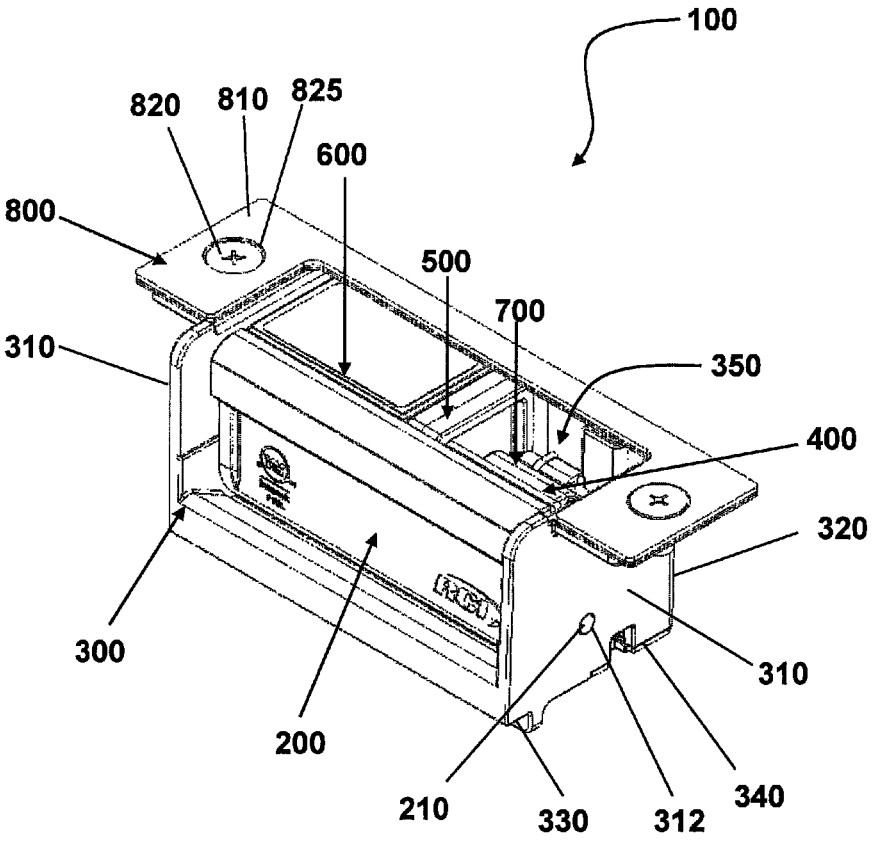
FIG. 1 is a front perspective view of an electric strike assembly, in accordance with certain aspects of the present invention.
Figure 2:
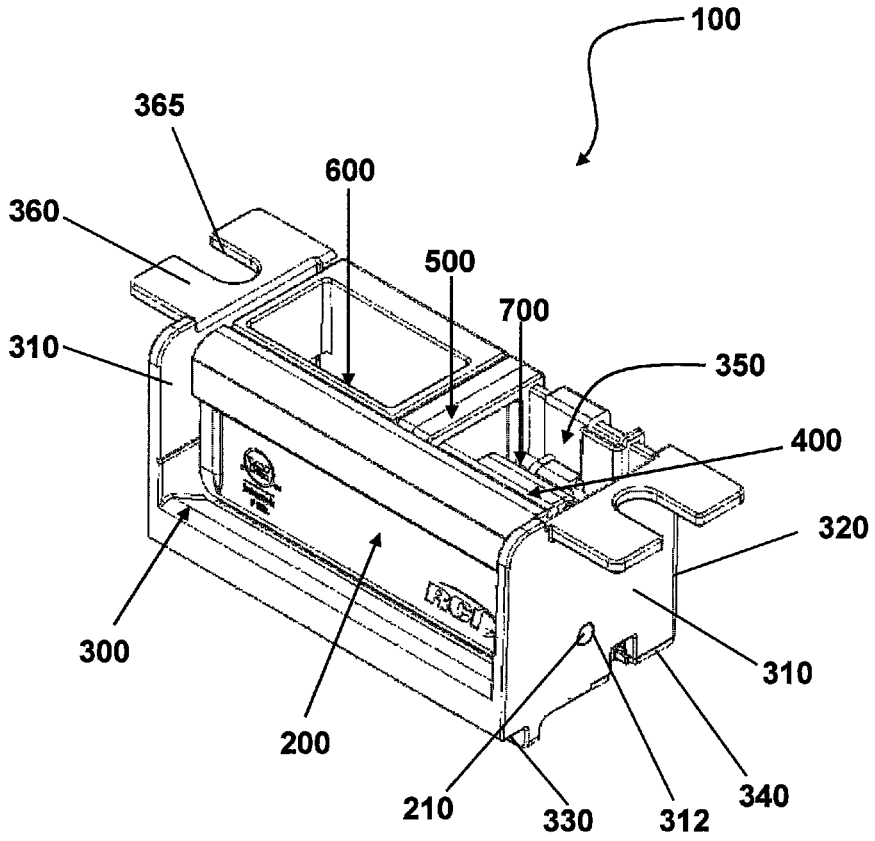
FIG. 2 is a front perspective view of an electric strike assembly with a faceplate removed, in accordance with certain aspects of the present invention.
Figure 3:
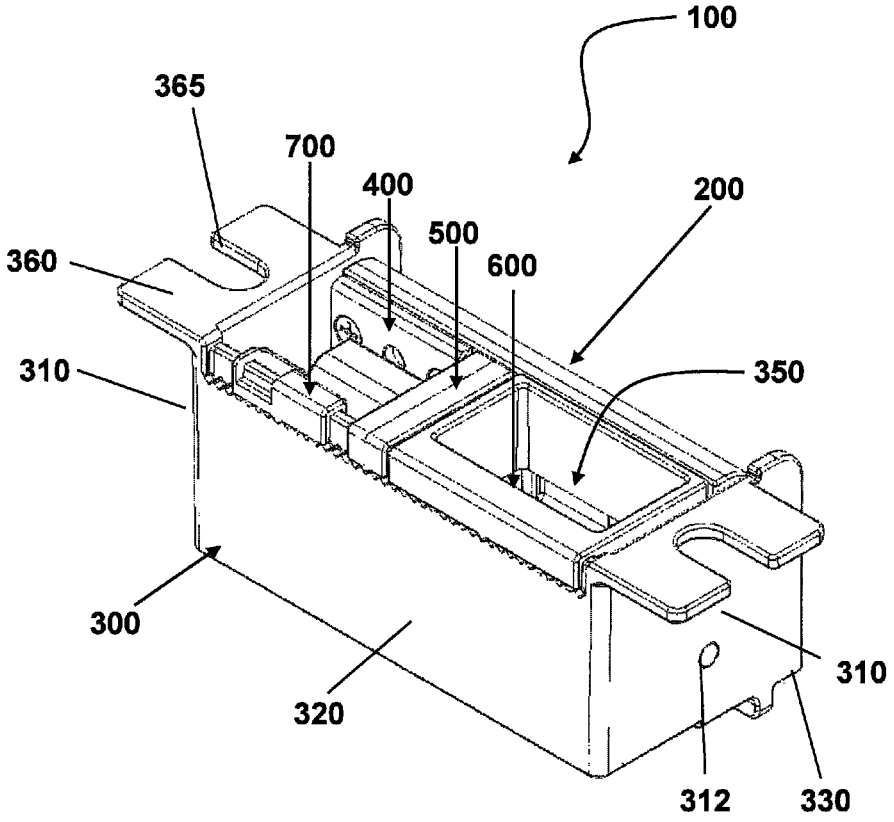
FIG. 3 is a rear perspective view of an electric strike assembly, in accordance with certain aspects of the present invention.
Figure 4:
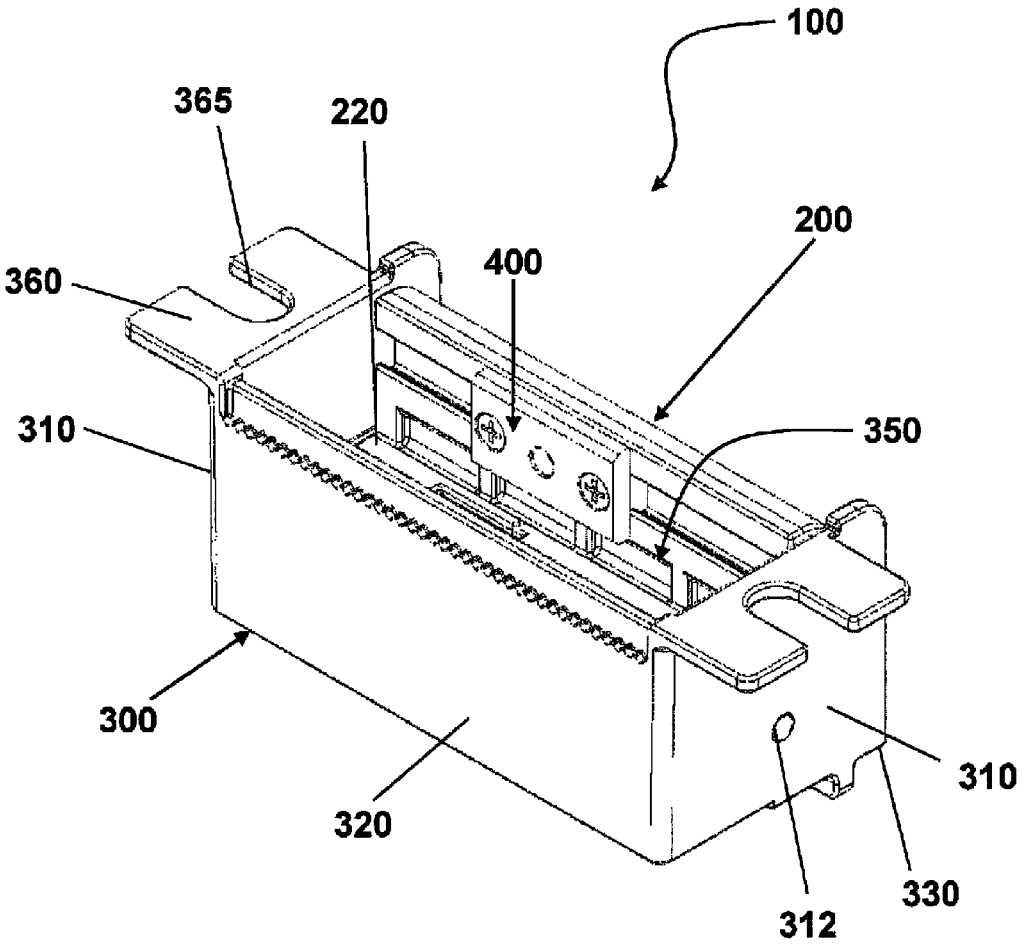
FIG. 4 is a rear perspective view of an electric strike assembly having an adjustable keeper shim assembly, in accordance with certain aspects of the present invention.

The invention will now be described with reference to the drawing figures, in which like reference numerals refer to like parts throughout.

Various aspects of an electric strike assembly may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of an electric strike assembly in addition to the orientation depicted in the drawings. By way of example, if aspects of an electric strike assembly shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of an electric strike assembly may be illustrated with reference to one or more exemplary embodiments. As used herein, the term "exemplary" means "serving as an example, instance, or illustration," and should not necessarily be construed as preferred or advantageous over other embodiments of an electric strike assembly disclosed herein.

FIGS. 1-4 illustrate an assembled electric strike assembly 100 in accordance with aspects of the present invention. The strike assembly 100 includes a keeper 200 pivotably mounted in a housing 300. The keeper 200 may be pivotable between a rotated position (see FIG. 9), which allows a latch bolt of a door to be removed from the strike to open the door, and a home position where the keeper 200, if prevented from moving, blocks removal of the latch bolt and thus keeps the door locked. When the keeper 200 is allowed to pivot, the latch bolt can push the keeper aside, so that the door can be opened.

As shown in FIGS. 1-6, the housing 300 may be integrally formed with end walls 310 and a rear wall 320 extending longitudinally between the end walls 310, and a bottom front wall 330 extending longitudinally between the end walls 310 and covering only a portion of the distance measured from the top to bottom of the strike assembly 100. A bottom plate 340 (see FIGS. 6A and 6B) may be separately mounted to the housing 300 to enclose an open bottom portion of the strike assembly 100. As shown in FIGS. 5A and 5B, a solenoid 242 and blocking element assembly 244 may be accessed for maintenance, for example, through the open bottom portion of the strike assembly 100 by removing the bottom plate 340. In accordance with yet other aspects of the present invention, the bottom plate 340 may be configured to have a louver surface 342 that slides behind a portion of the bottom front wall 330 to prevent tampering. As shown in FIGS. 1-6, pivot holes 312 may be provided in the end walls 310 for rotatably mounting the keeper 200 to the housing 300 via the pivot pins 210 (see also FIG. 7).

Figure 5A:
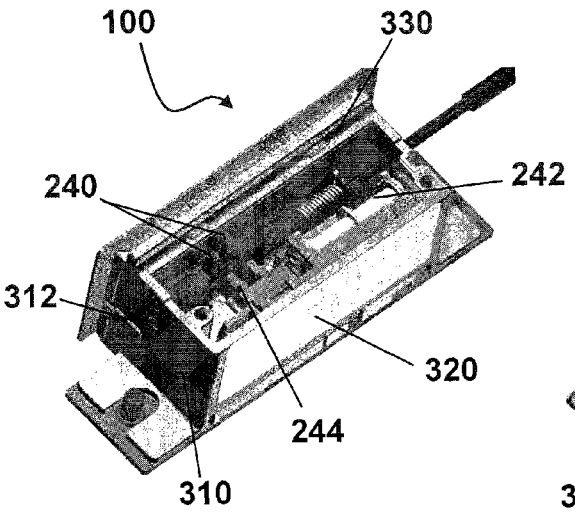
FIGS. 5A and 5B are bottom rear perspective views of an electric strike assembly showing a solenoid and blocking assembly in alternate positions according to a selected mode of the electric strike assembly, in accordance with certain aspects of the present invention.
Figure 5B:
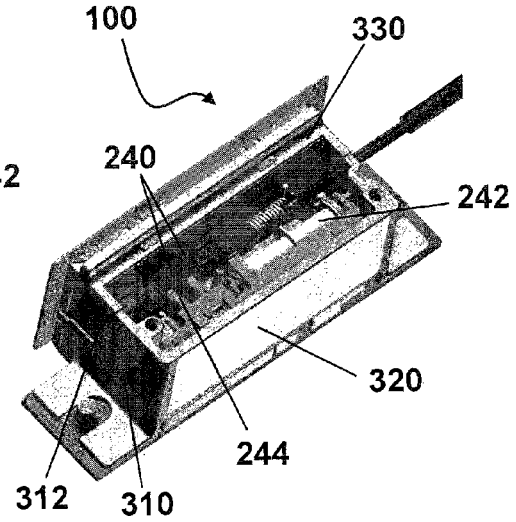

Control over the pivoting of the keeper 200 may be provided by the solenoid 242 and the blocking element assembly 244, as is well known in the art. For example, the keeper 200 may be biased toward the home position by a suitable biasing means, such as a torsion spring 230 (see FIG. 7). For the door to be locked, i.e. for the keeper 200 to be prevented from pivoting, the keeper 200 has at least one and preferably several abutments 240 that are opposed by the blocking element assembly 244. For the door to be able to open freely, i.e. for the keeper 200 to be allowed to pivot, the abutments 240 are not opposed by the blocking element assembly 244 so that the keeper 200 may freely rotate about one or more pivot pins 210. In a fail-secure mode, as shown in FIG. 5A, for example, the blocking element assembly 244 is actuated by the solenoid to move out of engagement with the abutments 240 (i.e., the abutments 240 do block in a power-off mode so the door is locked) and/or in a fail-safe mode, as shown in FIG. 5B, the blocking element assembly 244 is actuated by the solenoid 242 to block the abutments 240 (i.e., the abutments do not block in a power-off mode so the door is unlocked). In either case, when the solenoid is energized, the blocking element assembly 244 will be actuated to allow or deny the pivoting motion of the keeper 200.

Figure 6A:
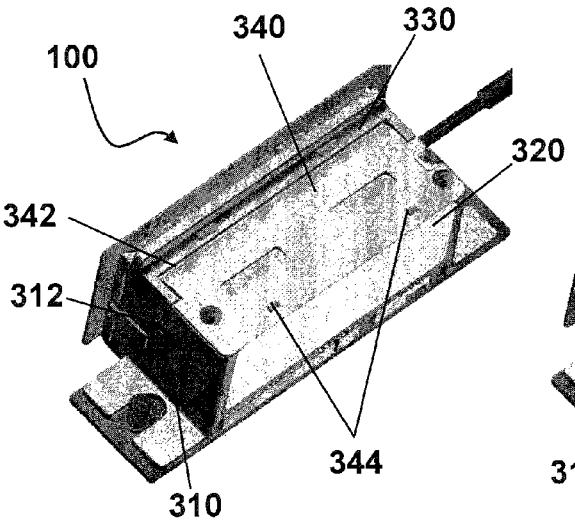
FIGS. 6A and 6B are bottom rear perspective views of the corresponding electric strike assemblies illustrated in FIGS. 5A and 5B respectively to illustrate a bottom plate with locator holes for positioning the solenoid and blocking assembly in alternate positions according to the selected mode of the electric strike assembly, in accordance with certain aspects of the present invention.
Figure 6B:
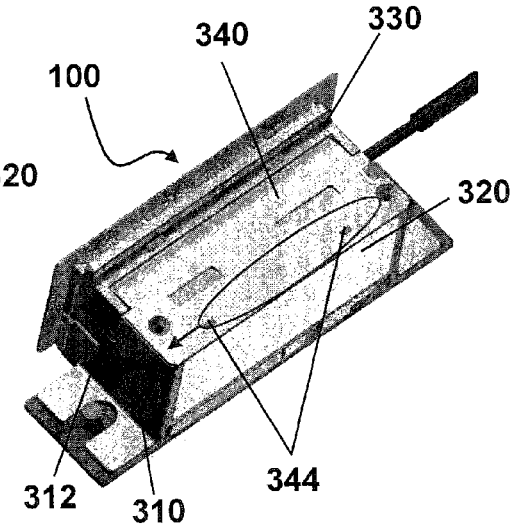

In accordance with yet another aspect of the present invention, as shown in FIGS. 6A and 6B, which correspond with FIGS. 5A and 5B respectively, the bottom plate 340 may be formed with solenoid locator holes 344 to mate with corresponding locating posts on the solenoid frame in order to selectively position the solenoid 242 and/or the blocking element assembly 244. In this manner, selection of the appropriate bottom plate 340 positions the locator holes 344 so that the solenoid 242 and blocking assembly 244 are positioned to enable the strike assembly 100 to function in one of a fail-secure mode or a fail-safe mode. For example, configuring the locator holes 344 to be located as shown in FIG. 6A may result in positioning of the solenoid 242 and blocking element assembly 244 as shown in FIG. 5A, corresponding to the fail-secure mode. On the other hand, configuring the locator holes 344 to be located as shown in FIG. 6B, which may be slightly offset in one direction as shown by the circle and arrow, may result in positioning of the solenoid 242 and blocking element assembly 244 as shown in FIG. 5B, corresponding to the fail-safe mode.

Figure 8:
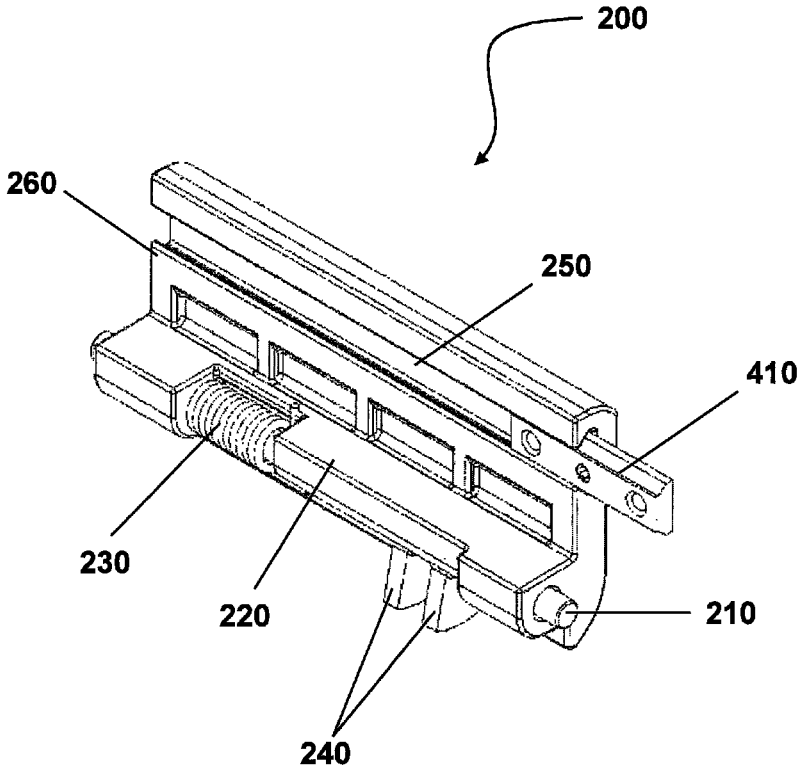
FIG. 8 illustrates an adjustment member engaged with a keeper for positioning a keeper shim assembly, in accordance with certain aspects of the present invention.

As shown in FIGS. 1-4, a strike cavity 350 is defined in the housing 300 by the end walls 310, the rear wall 320, the keeper 200 and a mid-wall 325 (see FIG. 9) that extends from the rear wall 320 and forms a substantially planar surface with a ledge 220 of the keeper 200 (see FIG. 8). In accordance with other aspects of the present invention, the mid-wall 325 may be a feature of the solenoid and blocking element assembly, such as an upper wall of a solenoid housing, for example.

Figure 17:
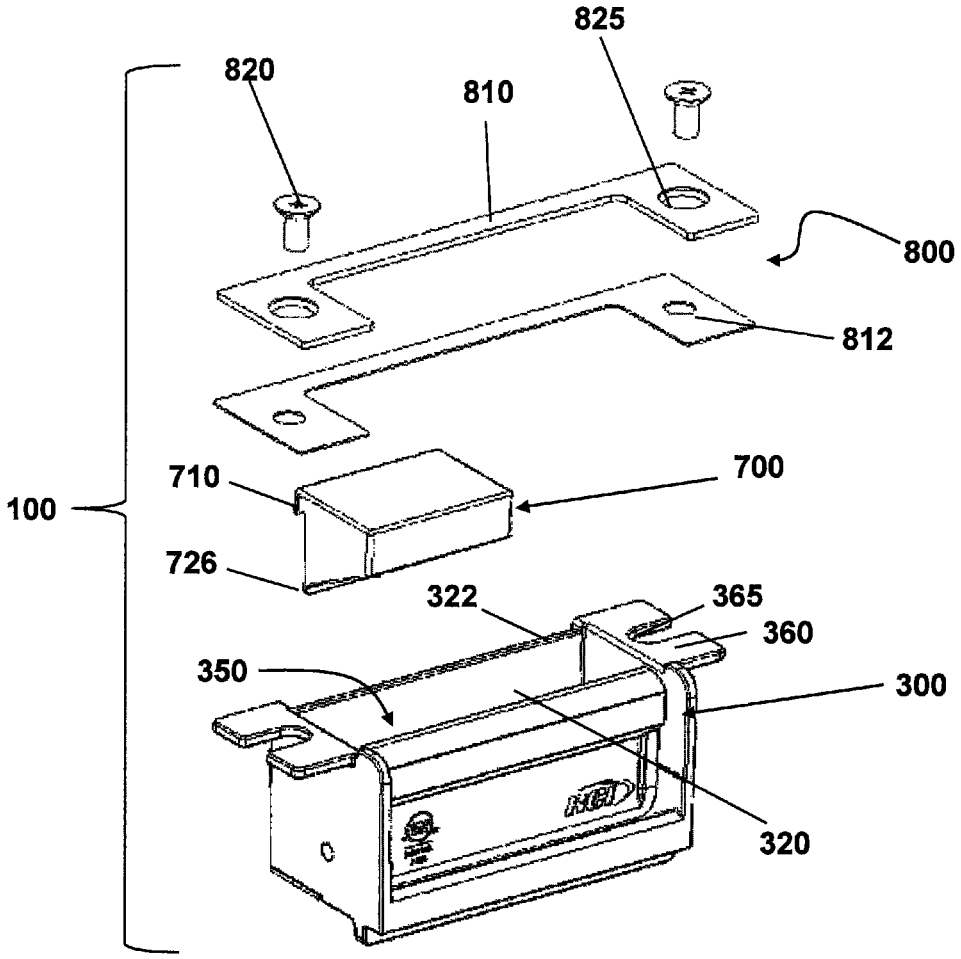
FIG. 17 illustrates a securing assembly for securing the dead bolt plug in a predetermined position, in accordance with certain aspects of the present invention.
Figure 18:
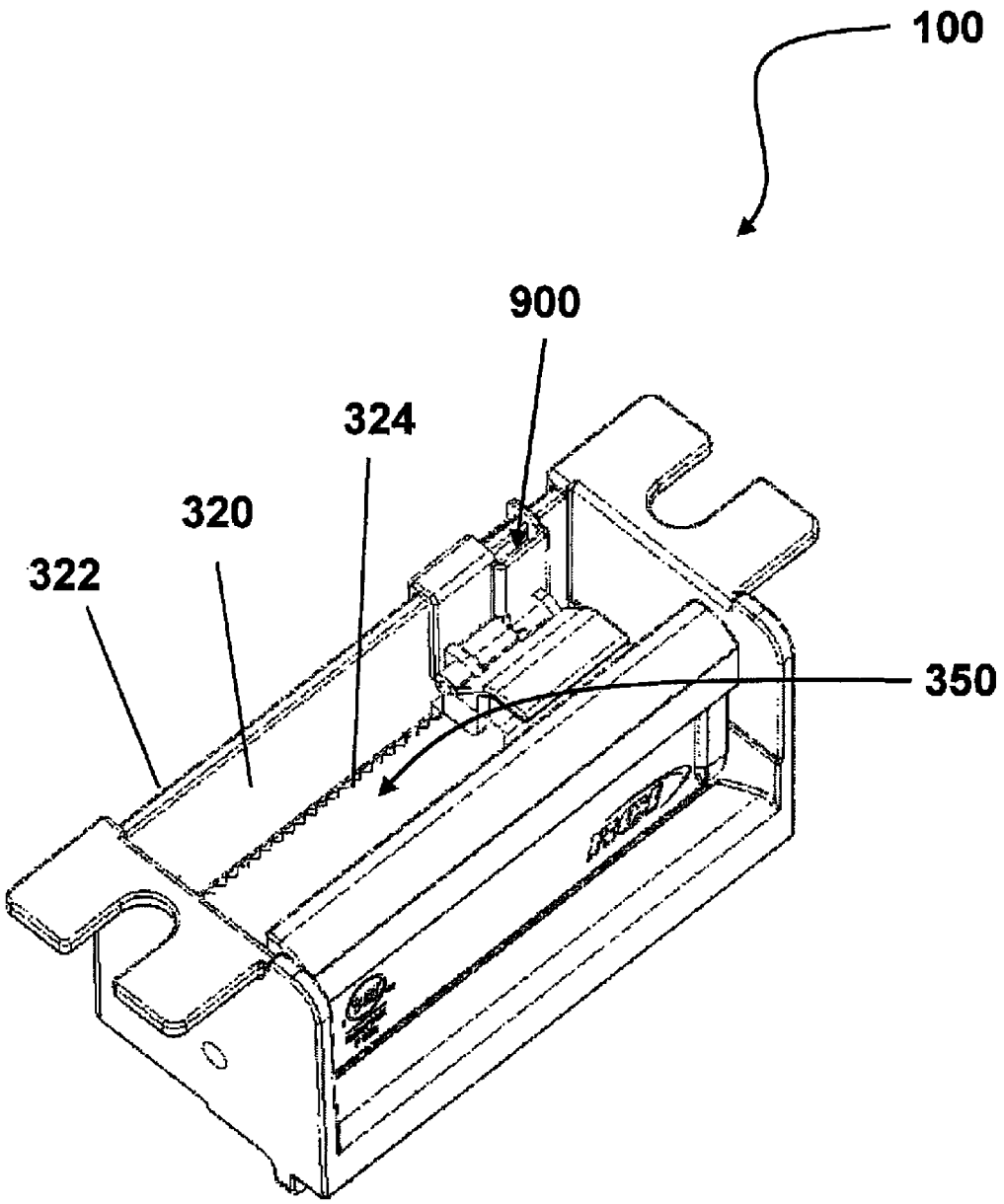
FIG. 18 is a front perspective view of an electric strike assembly having a latch monitor module positioned on the strike housing, in accordance with certain aspects of the present invention.
Figure 19:
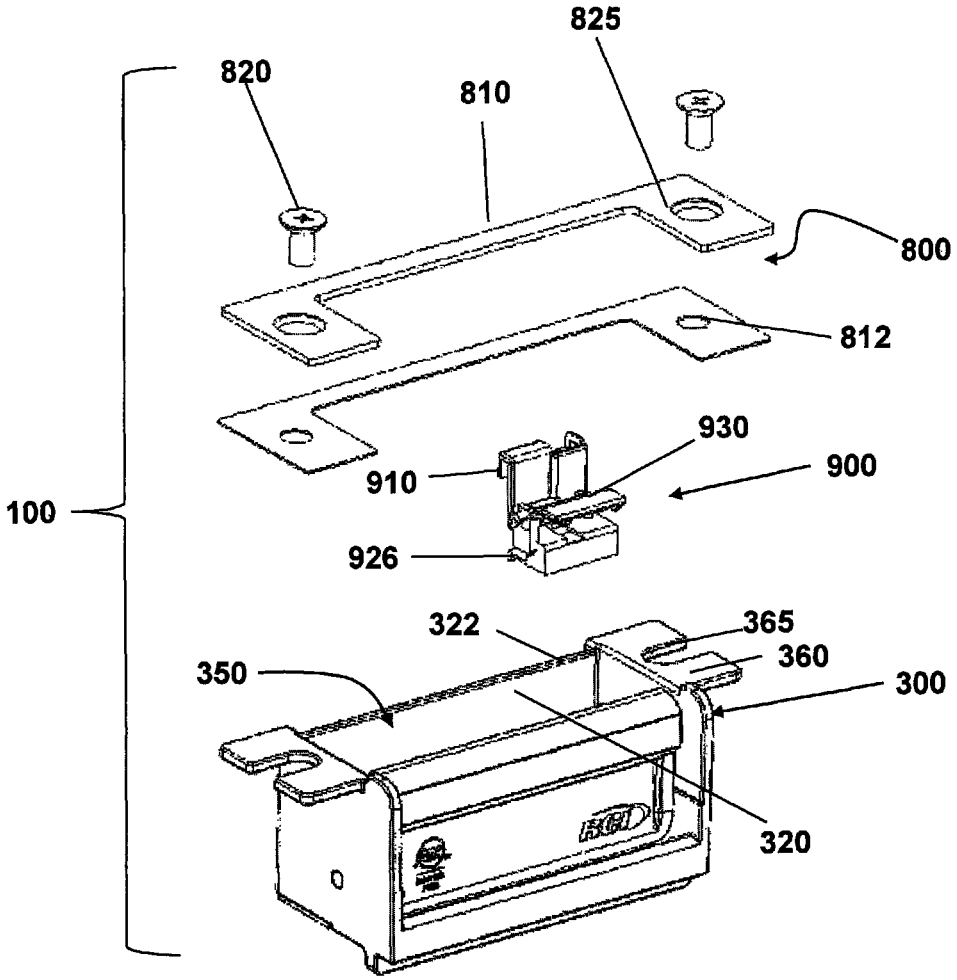
FIG. 19 illustrates a securing assembly for securing the latch monitor module in a predetermined position, in accordance with certain aspects of the present invention.

As described in further detail infra, the strike cavity 350 may extend substantially the entire longitudinal length of the strike assembly 100 and be configured to accommodate interchangeable and adjustable components including, among others, a keeper shim assembly 400 (see FIGS. 7-9), a dead locking lever or guard bolt bracket 500 (see FIGS. 10-13), a dead bolt bracket 600 (see FIGS. 14-15), a dead bolt plug, 700 (see FIGS. 16-17), and/or a latch monitor module 900 (see FIGS. 18 and 19). As shown in FIGS. 1, 13, 15, 17, and 19, a securing assembly 800, including a faceplate 810 and/or a suitable adhesive 812, for example, may be provided to further secure these components at predetermined positions in the strike cavity 350.

In an exemplary configuration, the faceplate 810 may secure the electric strike assembly 100 to the door jamb by a suitable attachment device, such as screws 820, which may extend through holes 825 in the faceplate 810. As shown more particularly in FIGS. 2 and 3, the housing 300 may include mounting flanges 360 extending perpendicularly from the end plates 310. The screws 820 may extend through the holes 825 in the faceplate 810, through holes or slots 365 provided in the mounting flanges 360, and into the door jamb to effectively secure the electric strike assembly 100 in place. The slots 365 in the mounting flanges 360 allow the position of the housing 300 to be longitudinally adjusted in relation to the faceplate 810.

Figure 7:
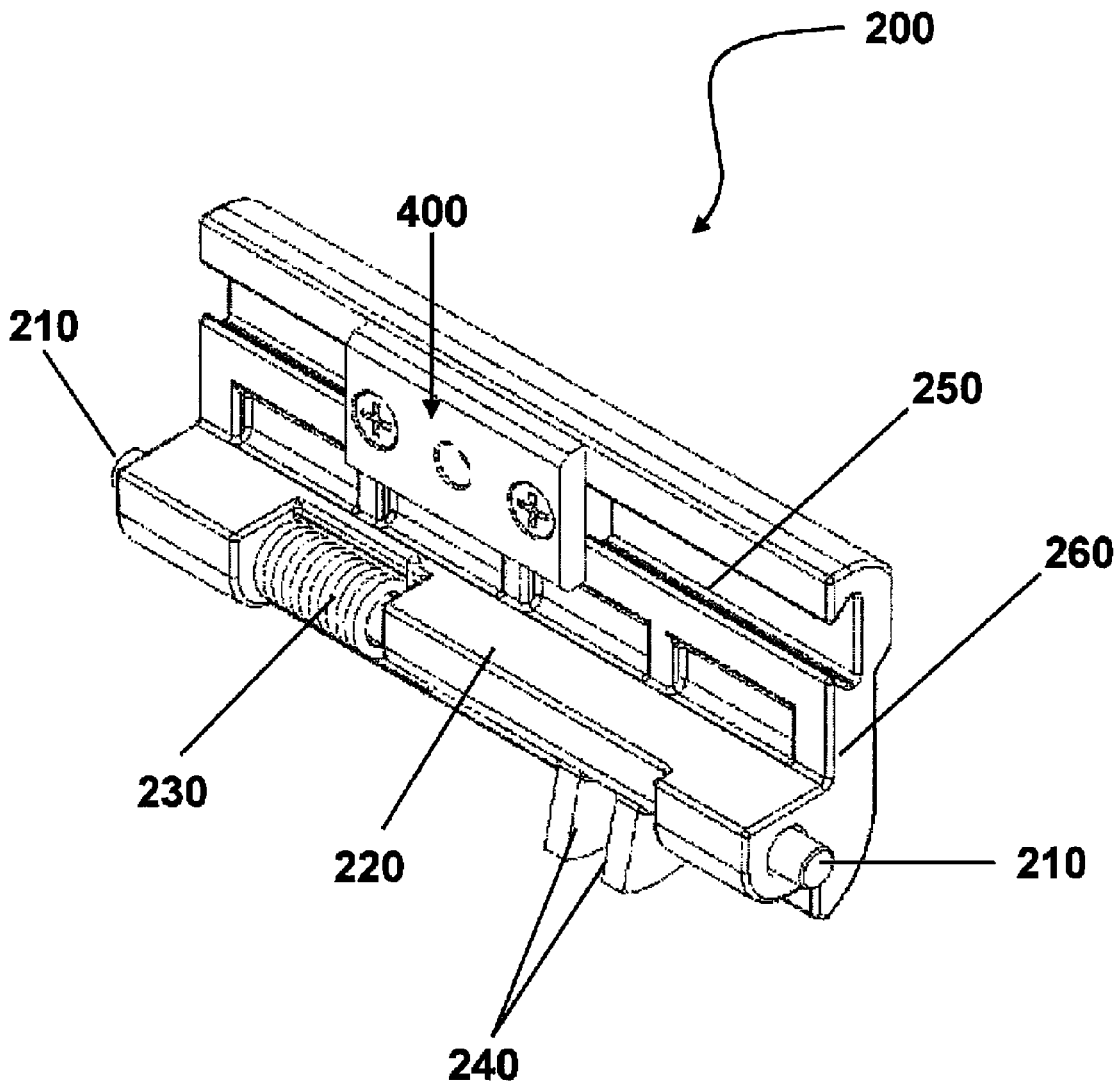
FIG. 7 is a perspective view of a keeper with an adjustable keeper shim assembly, in accordance with certain aspects of the present invention.
Figure 9:
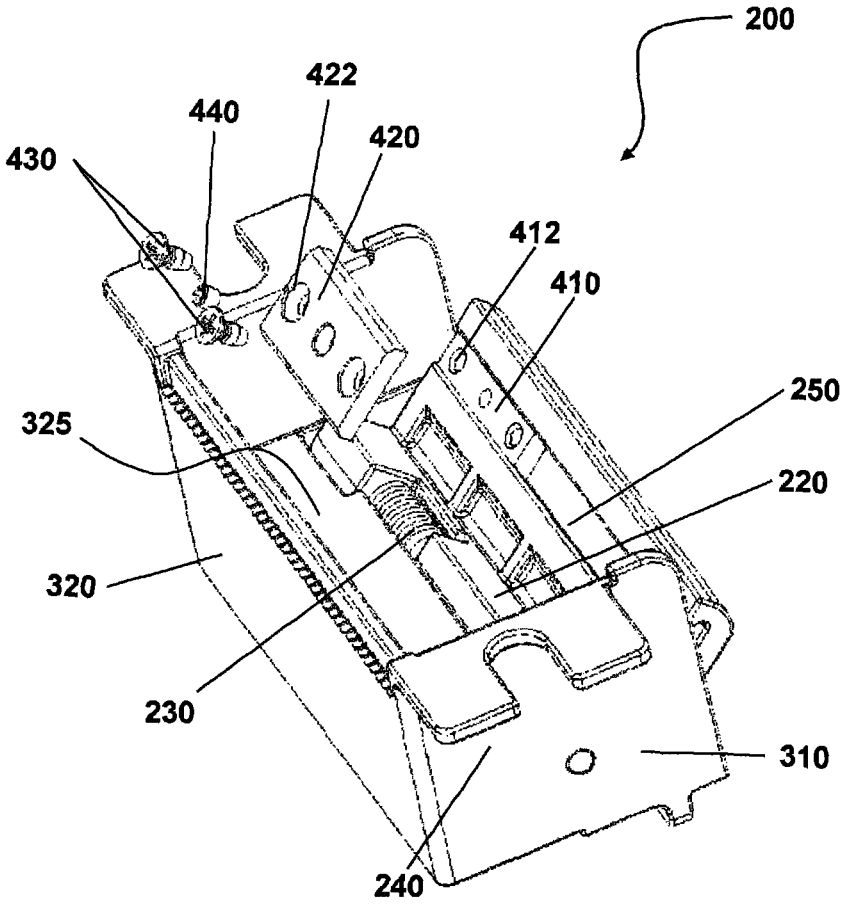
FIG. 9 is an exploded view of a keeper shim assembly positioned for coupling with an adjustment member, in accordance with certain aspects of the present invention.

When installed in the door jamb, by virtue of the strike cavity 350 extending substantially the entire length of the strike assembly 100, the strike cavity 350 may receive the locking feature(s) of the lock set, such as the latch bolt, dead bolt and/or guard bolt, along any longitudinal point of the strike assembly 100 regardless of where dimensionally the locking feature(s) is located with respect to the center of the strike assembly 100. Furthermore, the interchangeability and adjustability of optional components allows an installer to configure the fit and function of the strike assembly 100 to provide the performance desired. For example, often there remains a certain amount of play between the door and frame after strike installation, which may be due to a horizontal gap formed between the latch bolt and the keeper 200 when the latch bolt is received in the cavity 350 of the strike assembly 100. As shown in FIGS. 7-9, an adjustable keeper shim assembly 400 may be slidably mounted into a shim channel 250 provided on a face 260 of the keeper 200. The adjustable keeper shim assembly 400 may include an adjustable member 410 slidably mounted and retained in the shim channel 250, such as through a dove-tail connection. As shown in FIG. 9, a configurable shim 420, which may be of a particular thickness (e.g., 1.5 mm or 3 mm) appropriately sized to eliminate the horizontal gap, may be removably attached to the adjustable member 410 by an appropriate attachment device, such as screws 430, which extend through holes 422 in the shim 420 to engage shim mounting holes 412 on the adjustable member 410. With the shim 420 thus mounted to the adjustable member 410, a locking screw 440 may be provided to lock the adjustable keeper shim assembly 400 at an appropriate position along the shim channel 250 corresponding to the longitudinal dimensional position of the corresponding latch bolt. In accordance with another aspect of the present invention, the screws 430 may be used to lock the adjustable keeper shim assembly 400 at an appropriate position along the shim channel 250, alone or in combination with the locking screw 440. Moreover, in accordance with yet another aspect of the present invention, when a shim 420 is not required, the locking screw 440 may be used to lock the adjustable member 410 at an appropriate location along the shim channel 250.

Figure 10:
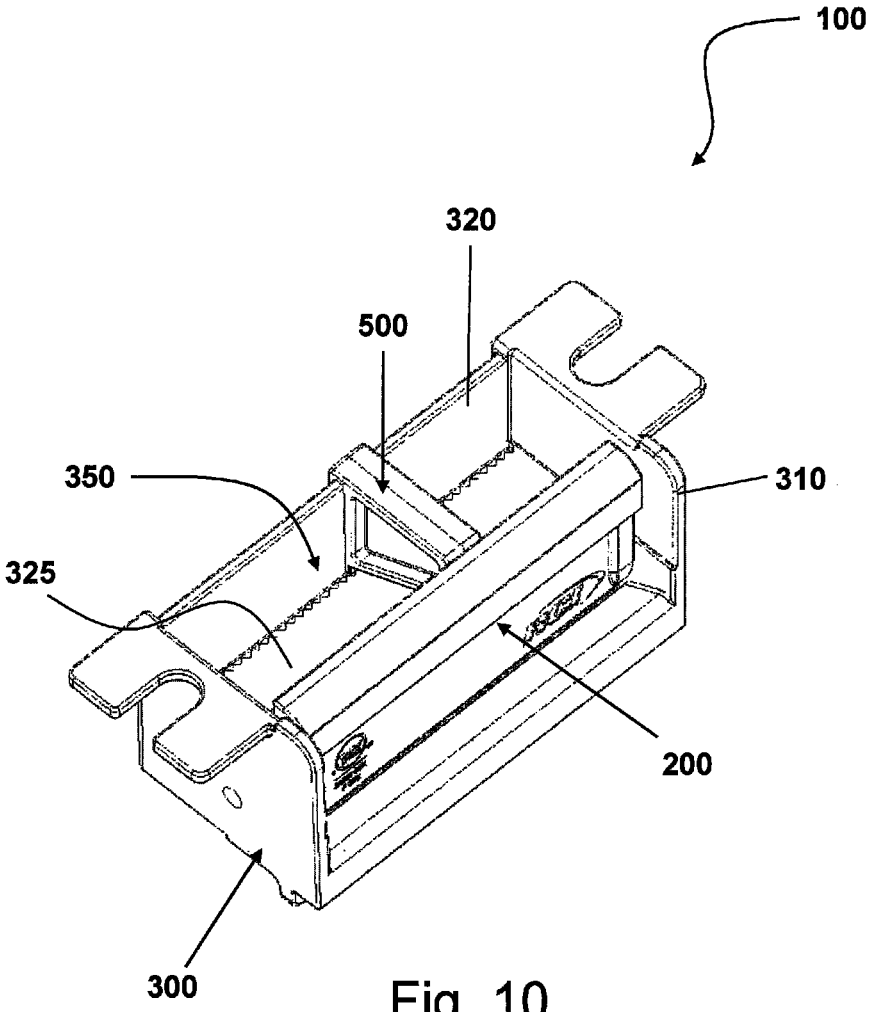
FIG. 10 is a front perspective view of an electric strike assembly having a dead locking lever or guard bolt bracket positioned on the strike housing, in accordance with certain aspects of the present invention.
Figure 11:
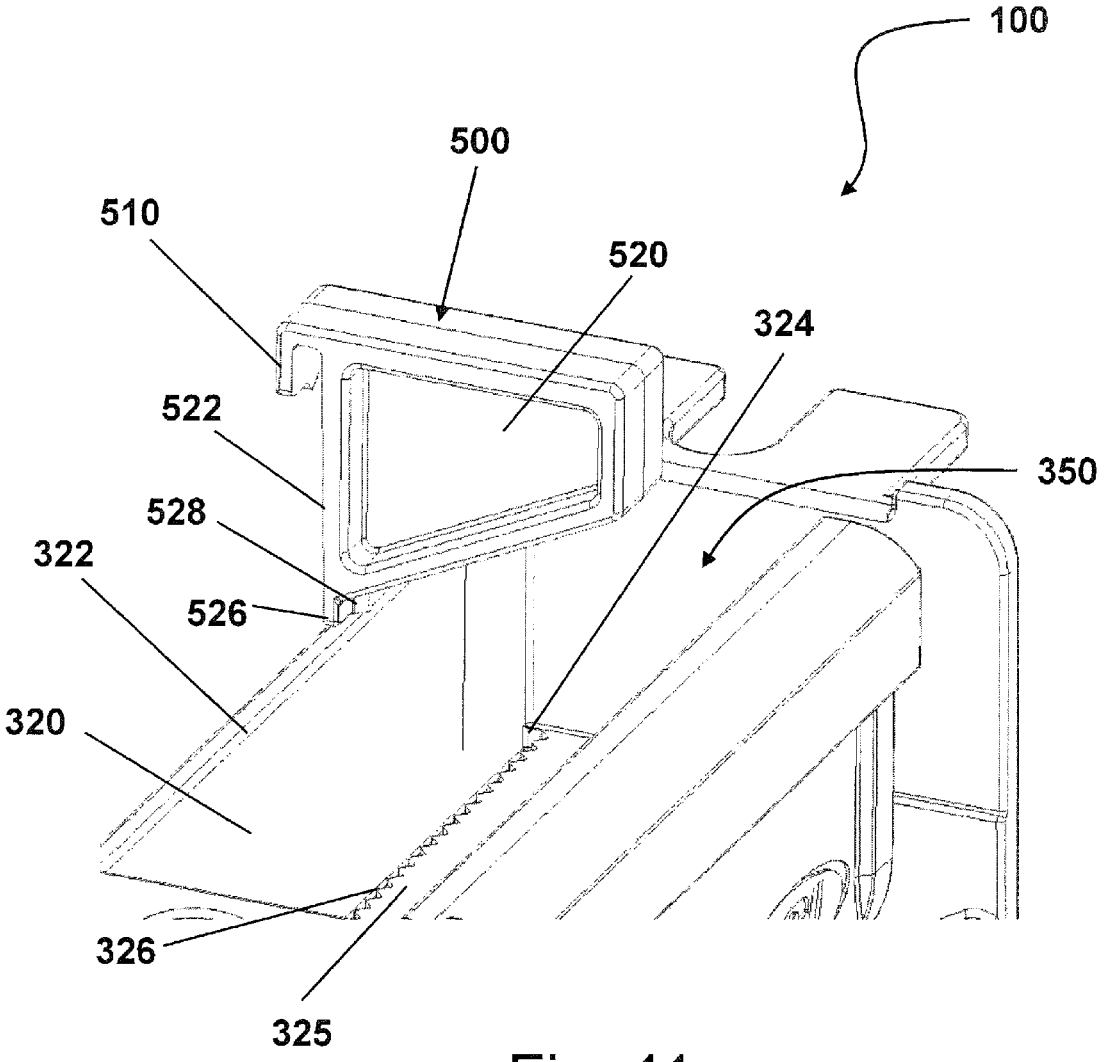
FIG. 11 is an enlarged front perspective view of a dead locking lever or guard bolt bracket having multiple positional engagement members for engaging multiple positional locking members on an electric strike assembly, in accordance with certain aspects of the present invention.
Figure 12:
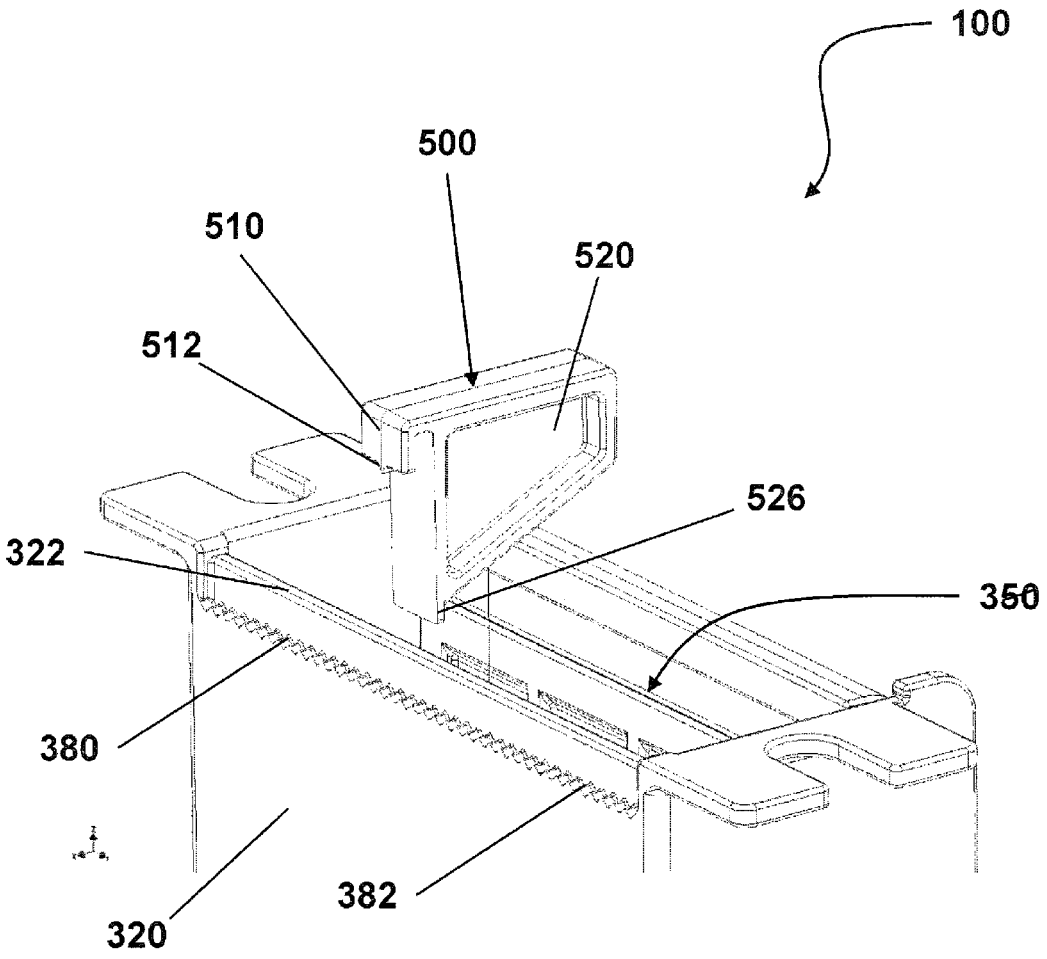
FIG. 12 is an enlarged rear perspective view of a dead locking lever or guard bolt bracket having multiple positional engagement members for engaging multiple positional locking members on an electric strike assembly, in accordance with certain aspects of the present invention.

In accordance with aspects of the present invention, various mounting devices may be provided for mounting and adjusting the position of optional interchangeable components that may be provided in the cavity 350. For example, as shown in FIGS. 10-12, a dead locking lever or guard bolt bracket 500 may be mounted into the cavity 350 at a desired longitudinal position. The dead locking lever or guard bolt bracket 500 may be easily locked into a predetermined position to interfere or push in the guard bolt of a lock set for providing extra security. When the guard bolt of a lock set is pushed in, the latch bolt cannot be depressed or pushed in. Furthermore, the dead locking lever or guard bolt bracket 500 may divide the cavity 350 into multiple compartments, wherein optional components, for example, can be simultaneously provided and protected from interference. In addition, the dead locking lever or guard bolt bracket 500 may provide additional support and strength to an optional component, such as a dead bolt bracket 600, by further bracing the dead bolt bracket 600 in a desired position.

As shown in FIG. 11, each optional component, and in this case the dead locking lever or guard bolt bracket 500, may be provided with a mounting member 510, such as an integrally formed hook flange, for example, to allow the dead locking lever or guard bolt bracket 500 to slidably engage an upper rail surface 322 of the rear wall 320. A body portion 520 of the dead locking lever or guard bolt bracket 500 may be formed with an abutment surface 522 for engaging the rear wall 320 of the housing and cooperating with the mounting member 510 to mount and support the dead locking lever or guard bolt bracket 500 on the rear wall 320.

One or more positioning members may be provided or integrally formed with the housing 300, for example, to lock the dead locking lever or guard bolt bracket 500 at a predetermined longitudinal position in the cavity 350. As shown in FIG. 11, for example, the mid-wall 325 may have a rail slot 324 formed at the intersection of the mid-wall 325 with the rear wall 320. The rail slot 324 may be configured to extend a predetermined depth into the mid-wall 325 and have a series of teeth 326, or suitable peaks and valleys, for engaging a lock extension 526 on the dead lock lever or guard bolt bracket 500. The lock extension 526 may be a continuation of the abutment surface 522 extending below the body portion 520 of the dead lock lever or guard bolt bracket 500, and may be formed with a positional engagement member 528, which may be a protrusion, such as a tooth, configured to engage one of the valleys between the teeth 326 of the rail slot 324. The lock extension 526 may thus slide down into the rail slot 324 so that the positional engagement member 528 is keyed to fit into a particular valley for positioning the dead lock lever or guard bolt bracket 500 at a predetermined longitudinal position in the cavity 350. The teeth 326 of the rail slot 324 may be formed to provide a series of precise, predetermined dimensional settings extending substantially the entire length of the cavity 350. For example, the positioning member described above may be configured to allow the optional component, i.e., the dead lock lever or guard bolt bracket 500, to be incrementally adjusted in 2 mm increments to position the optional component at virtually any position along the longitudinal length of the cavity 350.

As shown in FIG. 12, in accordance with another aspect of the present invention, a second positioning member may be provided or integrally formed with the housing 300 for mounting and locking the optional component, in this case the dead lock lever or guard bolt bracket 500, at a particular position in the cavity 350, alone or in combination with the positioning member discussed above. The rear wall 320 may be integrally formed with a rail 380 having a series of teeth 382, which form intervening valleys for engaging a corresponding mating member 512, such as a tooth, on the mounting member 510. The rail 380 may be formed on an upper portion of the rear wall 320 toward the upper rail surface 322 in order that a substantial portion of the rear wall 320 may remain as thick as possible, allowing for increased strength and stability of the strike assembly 100. When formed with dual positioning members, the teeth 382 of the rail 380 may be incrementally formed in parallel and in line with the teeth 326 of the rail slot 324 so that the positional engagement member 528 and the mating member 512 may lock into place at the same predetermined longitudinal position with respect to the length of the cavity 350. In accordance with another aspect of the present invention, one or more of the positional engagement member 528, the mating member 512, the teeth 382 and the teeth 326 may be provided in an offset configuration. For example, the positional engagement member 528 may engage the teeth 326 of the rail slot 324 at a different relative longitudinal position in the cavity 350 than the position at which the mating member 512 engages the teeth 382 of the rail 380.

Figure 13:
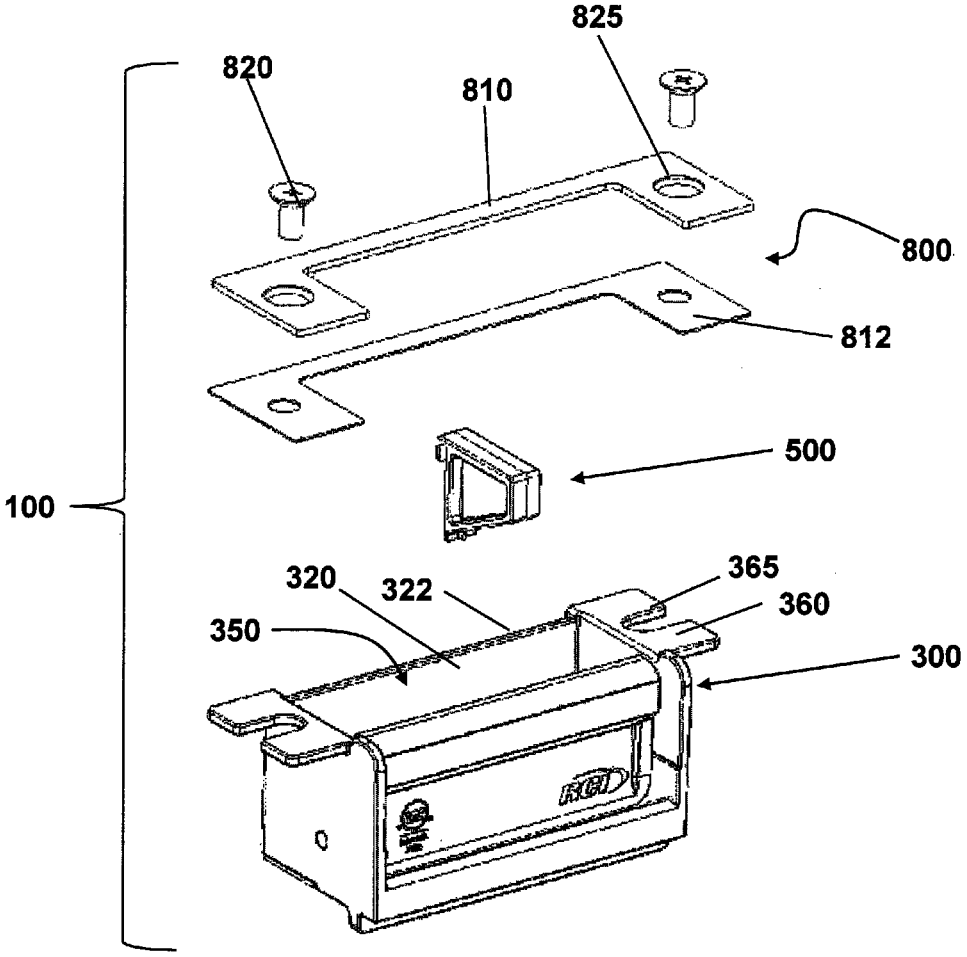
FIG. 13 illustrates a securing assembly for securing the dead locking lever or guard bolt bracket in a predetermined position, in accordance with certain aspects of the present invention.

As shown in FIG. 13, the strike assembly 100 may be assembled by placing the optional component, i.e. the dead locking lever or guard bolt bracket 500, at a desired position along the longitudinal length of the cavity 350. The mounting devices lock the dead locking lever or guard bolt bracket 500 at the predetermined position and, as described above, the securing assembly 800, including a faceplate 810 and/or a suitable adhesive layer 812 may be provided to further secure the dead locking lever or guard bolt bracket 500 at the predetermined position in the strike cavity 350 by preventing the mounting member 510 from disengaging the upper rail surface 322 of the rear wall 320. In an exemplary configuration, the faceplate 810 may secure the electric strike assembly 100 to the door jamb by a suitable attachment device, such as screws 820, which may extend through holes 825 in the faceplate 810, through the slots 365 provided in the mounting flanges 360, and into the door jamb to effectively secure the electric strike assembly 100 in place.

Figure 14:
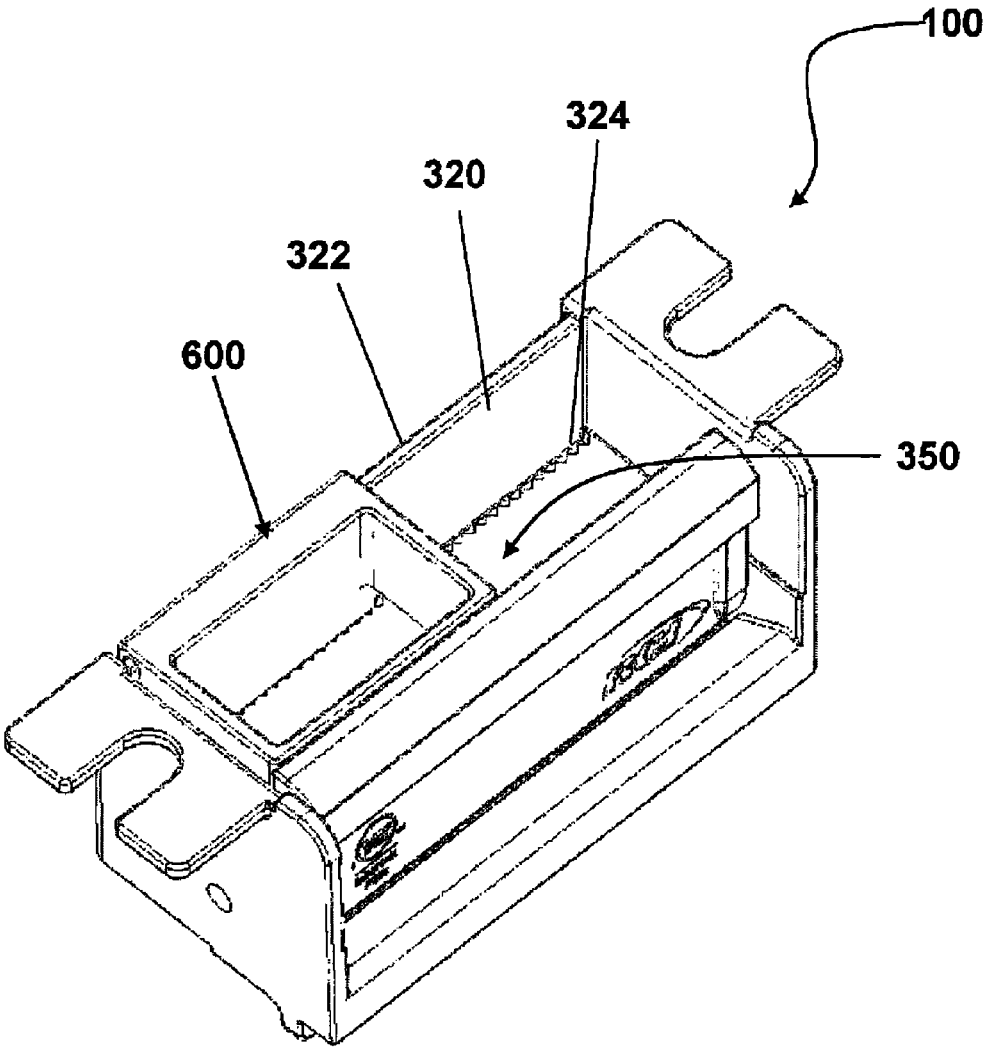
FIG. 14 is a front perspective view of an electric strike assembly having a dead bolt bracket positioned on the strike housing, in accordance with certain aspects of the present invention.
Figure 15:
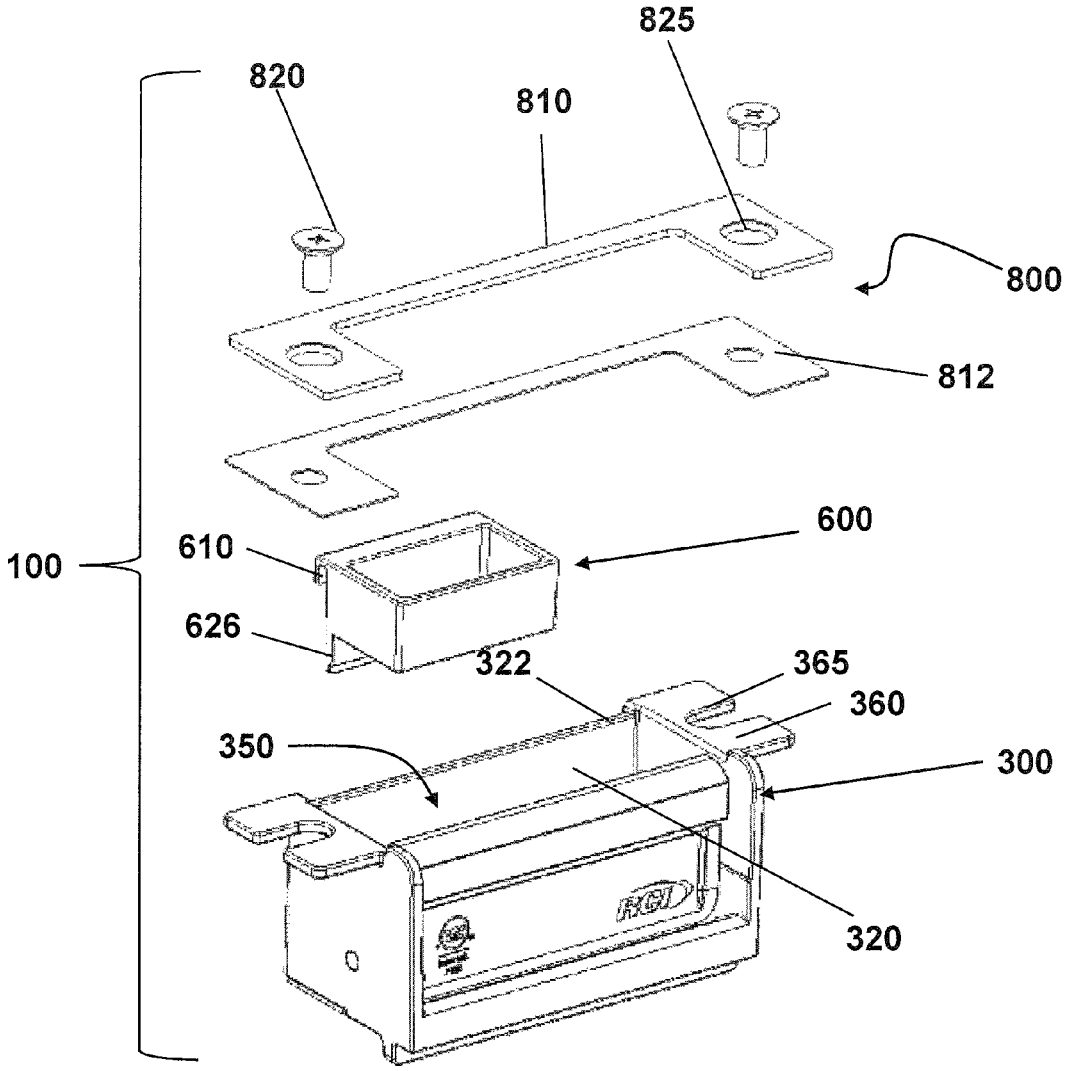
FIG. 15 illustrates a securing assembly for securing the dead bolt bracket in a predetermined position, in accordance with certain aspects of the present invention.

FIGS. 14 and 15 illustrate a configuration of the strike assembly 100, wherein many of the features are the same as or similar to those described above, however the optional component to be inserted into the cavity 350 is a dead bolt bracket 600 having a mounting member 610 for engaging the upper rail surface 322 of the rear wall 320 and a lock extension 626 for engaging the rail slot 324. The dead bolt bracket 600 provides additional support for receiving a dead bolt while maintaining a separate compartment in the cavity 350 for receiving the latch bolt, the guard bolt, and/or any other optional components that may be configured into the strike assembly 100.

Figure 16:
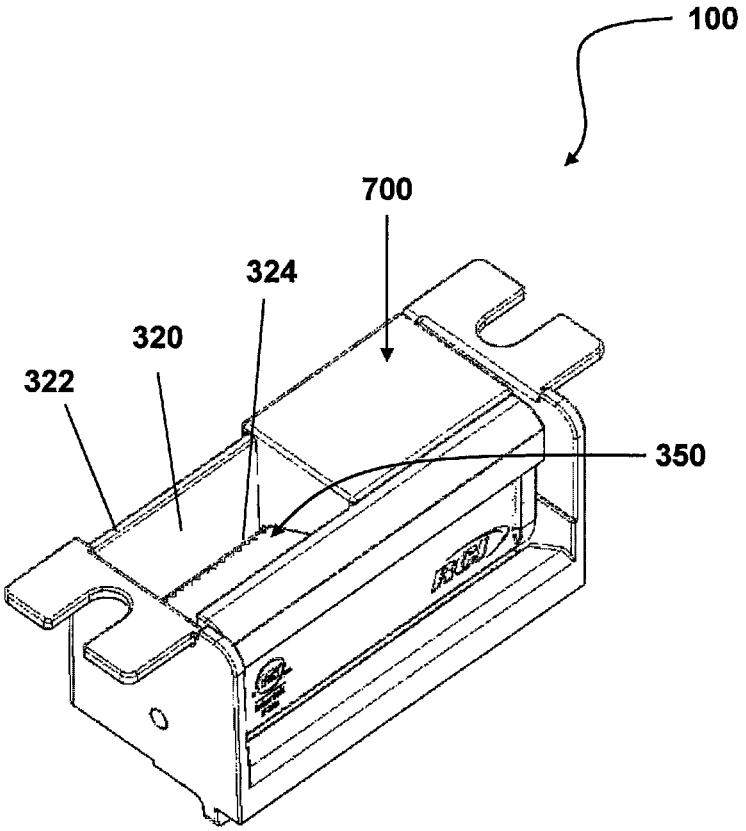
FIG. 16 is a front perspective view of an electric strike assembly having a dead bolt plug positioned on the strike housing, in accordance with certain aspects of the present invention.

FIGS. 16 and 17 illustrate a configuration of the strike assembly 100, wherein many of the features are the same as or similar to those described above, however the optional component to be inserted into the cavity 350 is a dead bolt plug 700 having a mounting member 710 for engaging the upper rail surface 322 of the rear wall 320 and a lock extension 726 for engaging the rail slot 324. The dead bolt plug 700 blocks use of a dead bolt while maintaining a separate compartment in the cavity 350 for receiving the latch bolt, the guard bolt, and/or any other optional components that may be configured into the strike assembly 100.

FIGS. 18 and 19 illustrate a configuration of the strike assembly 100, wherein many of the features are the same as or similar to those described above, however the optional component to be inserted into the cavity 350 is a removable latch monitor module 900 having a mounting member 910 for engaging the upper rail surface 322 of the rear wall 320 and a lock extension 926 for engaging the rail slot 324. The latch monitor module 900 operates, for example, to identify when the door is closed and the latch bolt of the door is fully extended and retained by the keeper 200 in the cavity 350. In an exemplary configuration of the latch monitor module 900, a latch bolt plate 930 is depressed when the door latch bolt is secured in the cavity 350, causing a cam or similar actuation device to activate a microswitch to send a signal to a remote monitoring device regarding the status of the door.

Figure 20:
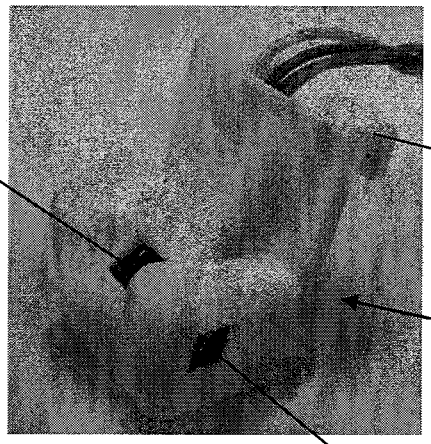
FIG. 20 illustrates a perspective view of a latch monitor module, in accordance with certain aspects of the present invention.
Figure 21:
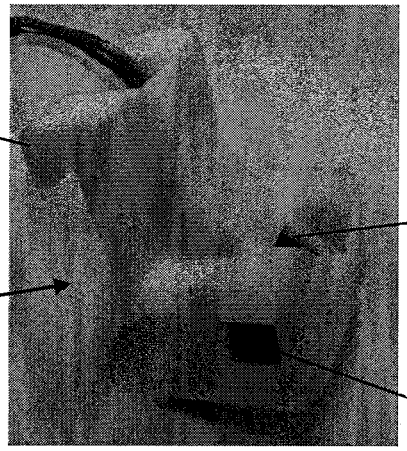
FIG. 21 illustrates another perspective view of the latch monitor module shown in FIG. 20, in accordance with certain aspects of the present invention.

In accordance with another aspect of the present invention, as shown in FIGS. 20 and 21, a removable latch monitor module 950 may be the optional component to be inserted in the cavity 350. The latch monitor module 950 may have a mounting member 952 for engaging the upper rail surface 322 of the rear wall 320. The latch monitor module 950 may also be configured with an infrared sensor 954 to identify when the door is closed and the latch bolt of the door is fully extended and retained by the keeper 200 in the cavity 350. In accordance with yet other aspects of the present invention, the latch monitor module 950 may include one or more sensors located on one or both sides of the module 950 for detecting a deadbolt on either side of the module 950. Thus, the latch monitor module 950 may be used to monitor the position of the latch as well as the deadbolt.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. An electric strike assembly, comprising:

a housing including a first positioning member, a mid-wall, a rear wall, and an internal longitudinal cavity;

an upper rail surface located on the rear wall, the upper rail surface defining a smooth unbroken surface along its length, the first positioning member includes a series of peaks and valleys incrementally formed along a length of the internal longitudinal cavity, the first positioning member being located on a rear face of the rear wall and below the upper rail surface;

a keeper having a longitudinal length, the keeper pivotally arranged in the housing, the keeper configured to pivot about a pivot axis and the smooth unbroken surface of the upper rail surface is as long as the longitudinal length of the keeper; and at least one selectively locatable component configured to slide along the upper rail surface having a first engagement member to cooperate with the first positioning member located below the upper rail surface to secure the at least one selectively locatable component at a predetermined incremental position along a length of the internal longitudinal cavity parallel to the pivot axis; and wherein the first engagement member and first positioning member cooperate at a position located on a rear face of the rear wall opposite a front face of the rear wall when the front face defines, in part, the internal longitudinal cavity.

2. The electric strike assembly of claim 1, wherein the at least one selectively locatable component includes a mounting member and an abutment surface for slidably supporting the at least one selectively locatable component on the rear wall.

3. The electric strike assembly of claim 2, further including a second positioning member defining a rail slot formed at an intersection of the mid-wall and the rear wall in the internal longitudinal cavity, and wherein a second engagement member is a protrusion on the at least one selectively locatable component extending from the abutment surface.

4. The electric strike assembly of claim 3, wherein the rail slot is configured with a second series of peaks and valleys and the protrusion is a tooth configured to securely fit into one of the valleys in the second series of peaks and valleys.

5. The electric strike assembly of claim 4, wherein the first positioning member is integrally formed on the rear wall.

6. The electric strike assembly of claim 5, wherein the series of teeth and valleys of the first positioning member are incrementally formed in parallel and in line with the second series of peaks and valleys of the rail slot so that the first engagement member and the second engagement member are each secured into place at a substantially equal longitudinal position with respect to the length of the internal longitudinal cavity.

7. The electric strike assembly of claim 1, wherein the first positioning member is integrally formed on the rear wall, and the first engagement member engages first positioning member to secure the locatable component at the predetermined incremental position in the internal longitudinal cavity.

8. The electric strike assembly of claim 7, wherein the first engagement member is a tooth configured to securely fit into one of the valleys of the first positioning member thereby allowing the first engagement member to be positioned at at least 10 positions along the first positioning member.

9. The electric strike assembly of claim 1, further comprising a faceplate attached to the housing for further securing the at least one selectively locatable component at the predetermined incremental position in the internal longitudinal cavity.

10. The electric strike assembly of claim 9, wherein the housing further includes a mounting flange having a slot configured to allow the housing to be longitudinally adjusted in relation to the faceplate.

11. The electric strike assembly of claim 1, wherein the at least one selectively locatable component is a guard bolt bracket, a dead bolt bracket, a dead bolt plug, or a latch monitor module.

12. The electric strike assembly of claim 1, further comprising an additional selectively locatable component.

13. The electric strike assembly of claim 12, wherein the selectively locatable components include a guard bolt bracket, a dead bolt bracket, a dead bolt plug, a latch monitor module or any combination thereof.

14. The electric strike assembly of claim 1, further comprising a shim channel formed in the keeper and a shim assembly slidably mounted into the shim channel.

15. The electric strike assembly of claim 14, wherein the shim assembly comprises an adjustable member slidably received into the shim channel and a shim removably attached to the adjustable member.

16. The electric strike assembly of claim 15, wherein the shim assembly further comprises a locking screw for adjustably locking the shim assembly at a predetermined shim position along the length of the internal longitudinal cavity.

17. An electric strike assembly, comprising:

a housing including an internal longitudinal cavity;

a rear wall being part of the housing having a smooth unbroken top surface along its length upon which a locatable component slides;

a keeper pivotally arranged in the housing, the keeper configured to pivot about a pivot axis; and a sliding plate residing inside a dovetail channel formed in the keeper along a length of the housing;

a keeper shim assembly, including a shim attached by a fastener into the sliding plate, the shim slidably engaged with the keeper to position the shim at a predetermined position that is adjustable along a length of the internal longitudinal cavity parallel to the pivot axis.

18. The electric strike assembly of claim 17, wherein the locatable component has an engagement member that cooperates with a positioning member on the housing to secure the locatable component at a predetermined incremental position along the length of the internal longitudinal cavity.

19. The electric strike assembly of claim 18, wherein the locatable component is a guard bolt bracket, a dead bolt bracket, a dead bolt plug or a latch monitor module.

20. A method of securely capturing a latch bolt mounted in a door, the method comprising:

mounting an electric strike assembly in an associated door jamb, the electric strike assembly comprising:

a housing including an internal longitudinal cavity;

a rear wall being part of the housing having an upper rail surface defining a smooth unbroken top surface along its length upon which a locatable component slides;

a first positioning member having a series of peaks and valleys incrementally formed along an entire length of the internal longitudinal cavity, the first positioning member being located on a rear face of the rear wall below the upper rail surface;

a keeper pivotally arranged in the housing, the keeper configured to pivot about a pivot axis; and wherein the locatable component has a first engagement member to cooperate with the first positioning member to secure the locatable component at a predetermined incremental position along a length of the internal longitudinal cavity parallel to the pivot axis;

a sliding surface on the rear wall located between the first positioning member and the smooth unbroken upper rail surface and the locatable component is configured to slide along the sliding surface;

a keeper shim assembly, including a shim, slidably engaged with the keeper to position the shim at a predetermined position along the length of the internal longitudinal cavity; and positioning the shim at the predetermined position in the cavity to be in substantial alignment with a position of the latch bolt mounted in the door.

21. The method of claim 20:

providing a second engagement member on the locatable component that cooperates with a second positioning member on the housing to secure the locatable component on the housing at a predetermined incremental position along the length of the internal longitudinal cavity.

* * * * *